US006345730B1

(12) United States Patent
Izuchukwu et al.

(10) Patent No.: US 6,345,730 B1
(45) Date of Patent: Feb. 12, 2002

(54) ADHESIVELY CONNECTED POLYMERIC PRESSURE CHAMBERS AND METHOD FOR MAKING THE SAME

(75) Inventors: John I. Izuchukwu, Wildwood; Stan A. Sanders, Chesterfield; Darrell Dearing, Camdenton, all of MO (US)

(73) Assignee: Mallinckrodt Inc., St. Louis, MO (US)

( * ) Notice: Subject to any disclaimer, the term of this patent is extended or adjusted under 35 U.S.C. 154(b) by 0 days.

(21) Appl. No.: 09/592,904

(22) Filed: Jun. 13, 2000

(Under 37 CFR 1.47)

(51) Int. Cl.[7] ..... A62B 7/00

(52) U.S. Cl. ..... 222/3; 222/212; 222/215; 128/205.27; 138/155

(58) Field of Search ..... 222/1, 3, 206, 222/212, 215; 128/205.27; 138/120, 155, 109; 285/331, 332

(56) References Cited

U.S. PATENT DOCUMENTS

| | | | | |
|---|---|---|---|---|
| 771,801 | A | 10/1904 | Andrew | |
| 1,288,857 | A | 12/1918 | Farr | |
| 2,380,372 | A | 7/1945 | Alderfer | 244/148 |
| 3,338,238 | A | 8/1967 | Warncke | 128/142.2 |
| 3,432,060 | A | 3/1969 | Cowley | 220/3 |
| 3,491,752 | A | 1/1970 | Cowley | 128/147 |
| 4,090,509 | A | 5/1978 | Smith | 128/142.5 |
| 4,181,993 | A | 1/1980 | McDaniel | 9/329 |
| 4,253,454 | A | 3/1981 | Warncke | 128/202.26 |
| 4,665,943 | A | 5/1987 | Medvick et al. | 137/543.17 |
| 4,800,923 | A | 1/1989 | Bartos | 137/613 |
| 4,932,403 | A | 6/1990 | Scholley | 128/205.22 |
| 4,964,405 | A | 10/1990 | Arnoth | 128/205.17 |
| 4,989,599 | A | 2/1991 | Carter | 128/207.18 |
| 5,036,845 | A | 8/1991 | Scholley | 128/205.22 |
| 5,127,399 | A | 7/1992 | Scholley | 128/205.22 |
| 5,323,953 | A | 6/1994 | Adderley et al. | 228/157 |
| 5,435,305 | A | 7/1995 | Rankin, Sr. | 128/205.22 |
| 5,494,469 | A | 2/1996 | Heath et al. | 441/118 |
| 5,517,984 | A | 5/1996 | Sanders | 128/205.22 |
| 5,529,061 | A | 6/1996 | Sanders | 128/205.22 |
| 5,582,164 | A | 12/1996 | Sanders | 128/205.22 |
| 5,830,400 | A | 11/1998 | Huvey et al. | 264/254 |
| 5,839,383 | A | 11/1998 | Stenning et al. | 114/72 |
| 6,003,460 | A | 12/1999 | Stenning et al. | 114/72 |
| 6,042,155 | A * | 3/2000 | Lockwood | 138/120 X |
| 6,047,860 | A | 4/2000 | Sanders | 222/3 |

FOREIGN PATENT DOCUMENTS

| | | |
|---|---|---|
| DE | 971689 | 3/1959 |
| DE | 2644806 | 4/1978 |
| FR | 1037477 | 9/1953 |
| WO | WO 97/11734 | 4/1997 |

* cited by examiner

*Primary Examiner*—Kenneth Bomberg
(74) *Attorney, Agent, or Firm*—Rothwell, Figg, Ernst & Manbeck

(57) ABSTRACT

A first strand of interconnected hollow polymeric chambers is connected to a second strand of interconnected hollow polymeric chambers. A connecting portion of the first strand has an outer surface contour conforming to a portion of the inner surface of a chamber. A partial chamber is formed on the end of the second strand, the partial chamber having an inner surface that conforms to the outer surface of the connecting portion. The connecting portion is inserted into the partial chamber and the two strands are held together by adhesive.

12 Claims, 10 Drawing Sheets

ADHESIVELY CONNECTED POLYMERIC PRESSURE CHAMBERS AND METHOD FOR MAKING THE SAME

FIELD OF THE INVENTION

The present invention is directed to interconnected polymeric chambers which may be used to form a light-weight, compact pressure vessel.

BACKGROUND OF THE INVENTION

There are many applications for a portable supply of fluid under pressure. For example, SCUBA divers and firefighters use portable, pressurized oxygen supplies. Commercial aircraft employ emergency oxygen delivery systems that are used during sudden and unexpected cabin depressurization. Military aircraft typically require supplemental oxygen delivery systems as well. Such systems are supplied by portable pressurized canisters. In the medical field, gas delivery systems are provided to administer medicinal gas, such as oxygen, to a patient undergoing respiratory therapy. Supplemental oxygen delivery systems are used by patients that benefit from receiving and breathing oxygen from an oxygen supply source to supplement atmospheric oxygen breathed by the patient. For such uses, a compact, portable supplemental oxygen delivery system is useful in a wide variety of contexts, including hospital, home care, and ambulatory settings.

High-pressure supplemental oxygen delivery systems typically include a cylinder or tank containing oxygen gas at a pressure of up to 3,000 psi. A pressure regulator is used in a high-pressure oxygen delivery system to "step down" the pressure of oxygen gas to a lower pressure (e.g., 20 to 50 psi) suitable for use in an oxygen delivery apparatus used by a person breathing the supplemental oxygen.

In supplemental oxygen delivery systems, and in other applications employing portable supplies of pressurized gas, containers used for the storage and use of compressed fluids, and particularly gases, generally take the form of cylindrical metal bottles that may be wound with reinforcing materials to withstand high fluid pressures. Such storage containers are expensive to manufacture, inherently heavy, bulky, inflexible, and prone to violent and explosive fragmentation upon rupture.

Container systems made from lightweight synthetic materials have been proposed. Scholley, in U.S. Pat. Nos. 4,932,403; 5,036,845; and 5,127,399, describes a flexible and portable container for compressed gases which comprises a series of elongated, substantially cylindrical chambers arranged in a parallel configuration and interconnected by narrow, bent conduits and attached to the back of a vest that can be worn by a person. The container includes a liner, which may be formed of a synthetic material such as nylon, polyethylene, polypropylene, polyurethane, tetrafluoroethylene, or polyester. The liner is covered with a high-strength reinforcing fiber, such as a high-strength braid or winding of a reinforcing material such as Kevlar® aramid fiber, and a protective coating of a material, such as polyurethane, covers the reinforcing fiber. The design described in the Scholley patents suffers a number of shortcomings which makes it impractical for use as a container for fluids stored at the pressure levels typically seen in portable fluid delivery systems such as SCUBA gear, firefighter's oxygen systems, emergency oxygen systems, and medicinal oxygen systems. The elongated, generally cylindrical shape of the separate storage chambers does not provide an effective structure for containing highly-pressurized fluids. Moreover, the relatively large volume of the storage sections creates an unsafe system subject to possible violent rupture due to the kinetic energy of the relatively large volume of pressurized fluid stored in each chamber.

SUMMARY OF THE INVENTION

According to one aspect of the invention, an assembly comprises a first strand of hollow polymeric chambers connected to a second strand of hollow polymeric chambers. The hollow chambers of the first strand are interconnected by conduit sections. The chambers have a larger interior width than the conduit sections, and an end one of the polymeric chambers of the first strand is formed so as to have a connecting portion defining an outer surface contoured so as to generally conform to a portion of an inner surface of a one of the hollow chambers. The chambers of the second strand are interconnected by conduit sections, and the hollow chambers have a larger interior width than the conduit sections. An end one of the polymeric chambers of the second strand is formed as a partial chamber defining an inner surface generally conforming to the outer surface of the connecting portion. The first strand is connected to the second strand by inserting the connecting portion of the first strand into the partial end chamber of the second strand with the outer surface of the connecting portion engaging the inner surface of the partial end chamber.

According to another aspect of the invention, a method comprises providing a first strand of hollow polymeric chambers interconnected by conduit sections. The hollow chambers have a larger interior width than the conduit sections. An end one of the polymeric chambers of the first strand is formed so as to have a connecting portion defining an outer surface contoured so as to generally conform to a portion of an inner surface of a one of the hollow chambers. A second strand of hollow polymeric chambers interconnected by conduit sections is provided. The hollow chambers have a larger interior width than the conduit sections. An end one of the polymeric chambers of the second strand is formed as a partial chamber defining an inner surface generally conforming to the outer surface of the connecting portion. An adhesive is applied to at least a portion of one of the outer surface of the connecting portion and the inner surface of the partial end chamber. The connecting portion of the first strand is inserted into the partial end chamber of the second strand.

Other objects, features, and characteristics of the present invention will become apparent upon consideration of the following description and the appended claims with reference to the accompanying drawings, all of which form a part of the specification, and wherein like reference numerals designate corresponding parts in the various figures.

DETAILED DESCRIPTION OF THE INVENTION

With reference to the figures, exemplary embodiments of the invention will now be described. These embodiments illustrate principles of the invention and should not be construed as limiting the scope of the invention.

Figure 1:
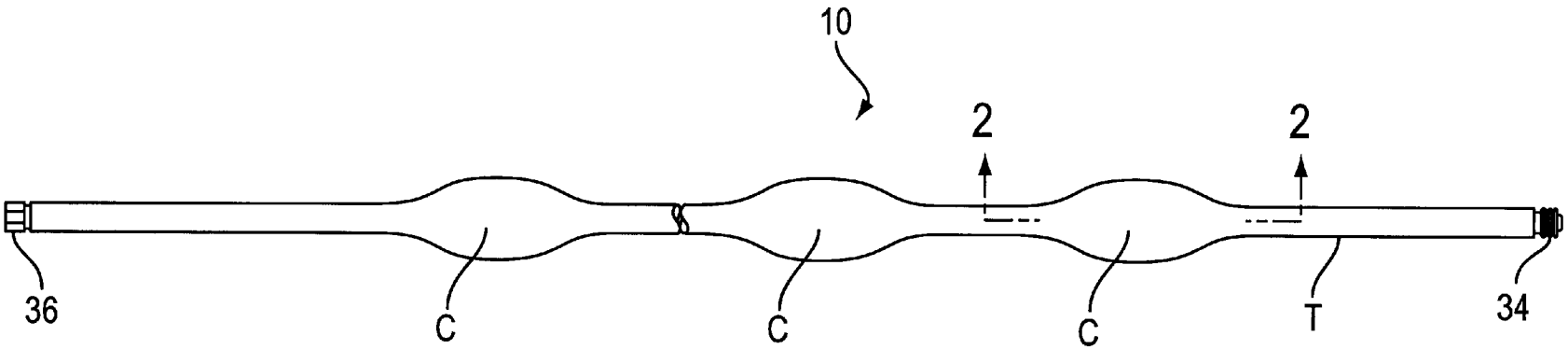
FIG. 1 is a broken side elevational view of a plurality of aligned, rigid, generally ellipsoidal chambers interconnected by a tubular core.
Figure 2:
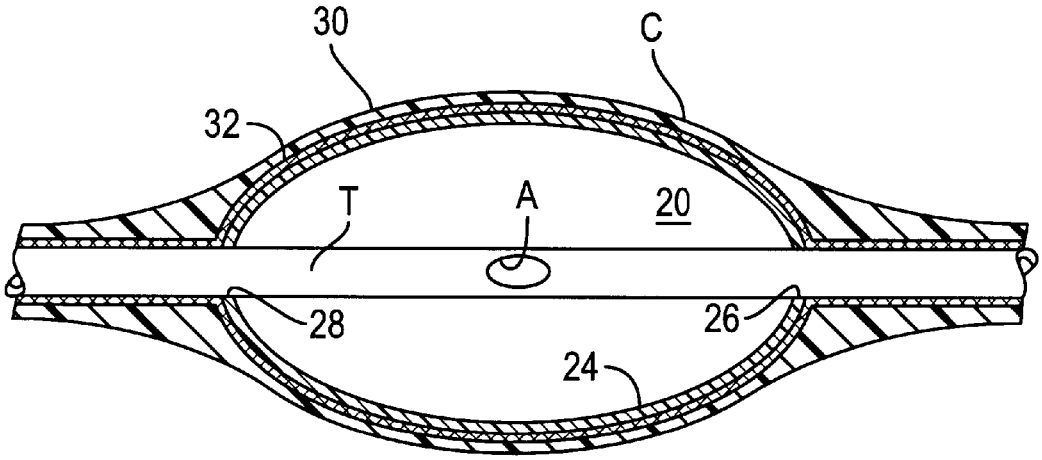
FIG. 2 is an enlarged horizontal sectional view taken along the line 2—2 in FIG. 1.

As shown in FIGS. 1 and 2, U.S. Pat. No. 6,047,860 (the disclosure of which is hereby incorporated by reference) to Sanders, an inventor of the present invention, discloses a container system 10 for pressurized fluids including a plurality of form-retaining, generally ellipsoidal chambers C interconnected by a tubular core T. The tubular core extends through each of the plurality of chambers and is sealingly secured to each chamber. A plurality of longitudinally-spaced apertures A are formed along the length of the tubular core, one such aperture being disposed in the interior space 20 of each of the interconnected chambers so as to permit infusion of fluid to the interior space 20 during filling and effusion of the fluid from the interior space 20 during fluid delivery or transfer to another container. The apertures are sized so as to control the rate of evacuation of pressurized fluid from the chambers. Accordingly, a low fluid evacuation rate can be achieved so as to avoid a large and potentially dangerous burst of kinetic energy should one or more of the chambers be punctured (i.e., penetrated by an outside force) or rupture.

The size of the apertures A will depend upon various parameters, such as the volume and viscosity of fluid being contained, the anticipated pressure range, and the desired flow rate. In general, smaller diameters will be selected for gasses as opposed to liquids. Thus, the aperture size may generally vary from about 0.010 to 0.125 inches. Although only a single aperture A is shown in FIG. 2, more than one aperture A can be formed in the tube T within the interior space 20 of the shell 24. In addition, each aperture A can be formed in only one side of the tube T, or the aperture A may extend through the tube T.

Referring to FIG. 2, each chamber C includes a generally ellipsoidal shell 24 molded of a suitable synthetic plastic material and having open front and rear ends 26 and 28. The diameters of the holes 26 and 28 are dimensioned so as to snugly receive the outside diameter of the tubular core T. The tubular core T is attached to the shells 24 so as to form a fluid tight seal therebetween. The tubular core T is preferably bonded to the shells 24 by means of light, thermal, or ultrasonic energy, including techniques such as, ultrasonic welding, radio frequency energy, vulcanization, or other thermal processes capable of achieving seamless circumferential welding. The shells 24 may be bonded to the tubular core T by suitable ultraviolet light-curable adhesives, such as 3311 and 3341 Light Cure Acrylic Adhesives available from Locate Corporation, having authorized distributors throughout the world. The exterior of the shells 24 and the increments of tubular core T between such shells are pressure wrapped with suitable pressure resistant reinforcing filaments 30 to resist bursting of the shells and tubular core. A protective synthetic plastic coating 32 is applied to the exterior of the filament wrapped shells and tubular core T.

More particularly, the shells 24 may be either roto molded, blow molded, or injection molded of a synthetic plastic material such as TEFLON or fluorinated ethylene propylene. Preferably, the tubular core T will be formed of the same material. The pressure resistant filaments 30 may be made of a carbon fiber, Kevlar® or Nylon. The protective coating 32 may be made of urethane to protect the chambers and tubular core against abrasions, UV rays, moisture, or thermal elements. The assembly of a plurality of generally ellipsoidal chambers C and their supporting tubular core T can be made in continuous strands of desired length. In the context of the present disclosure, unless stated otherwise, the term "strand" will refer to a discrete length of interconnected chambers.

Figure 2A:
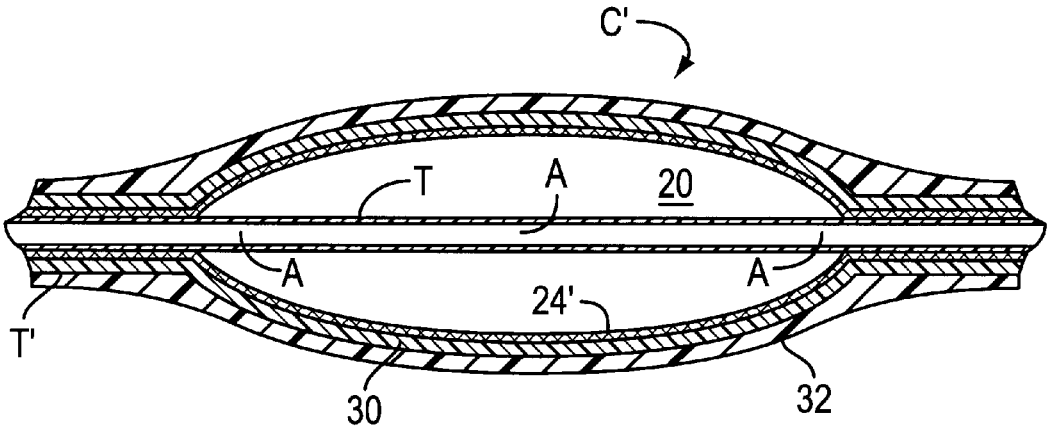
FIG. 2A is an enlarged horizontal sectional view taken along the line 2—2 in FIG. 1 showing an alternate embodiment.

As shown in FIG. 2A, the tube T can be co-formed, such as by co-extrusion, along with shells 24' and tubular portions T' integrally formed with the shells 24' and which directly overlie the tube T between adjacent shells 24'. Furthermore, as also shown in FIG. 2A, more than one aperture A may be formed in the tube T within the interior 20 of the shell 24'. The co-formed assembly comprised of the shells 24', tubular portions T', and tube T can be wrapped with a layer of reinforcing filaments 30 and covered with a protective coating 32 as described above.

The inlet or front end of the tubular core T may be provided with a suitable threaded male fitting 34. The discharge or rear end of a tubular core T may be provided with a threaded female fitting 36. Such male and female fittings provide a pressure-type connection between contiguous strands of assemblies of chambers C interconnected by tubular cores T and provide a mechanism by which other components, such as gauges or valves, can be attached to the interconnected chambers.

Figure 3:
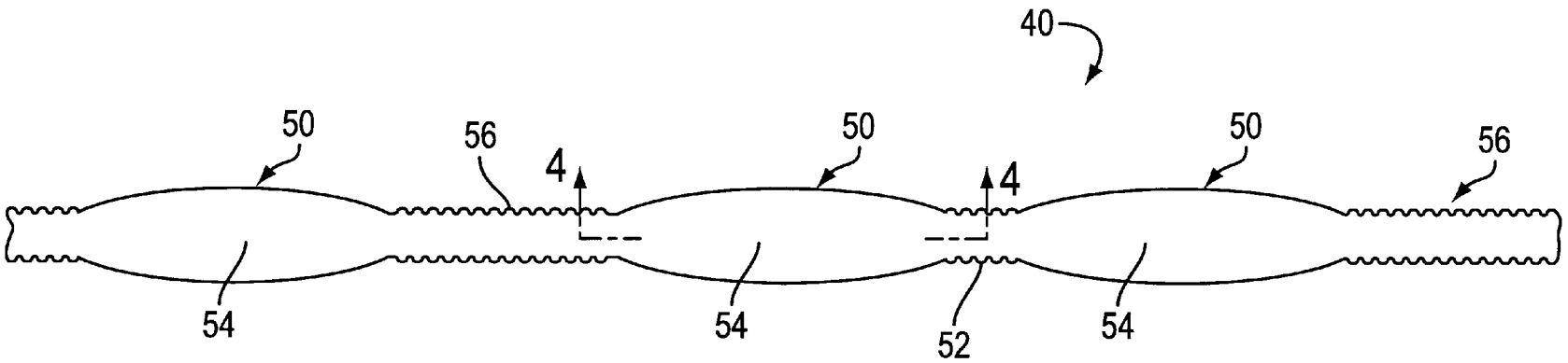
FIG. 3 is a side elevational view of a portion of a container system of the present invention.

A portion of an alternate pressure vessel is designated generally by reference number 40 in FIG. 3. The pressure vessel 40 includes a plurality of fluid storage chambers 50 having a preferred ellipsoidal shape and having hollow interiors 54. The individual chambers 50 are pneumatically interconnected with each other by connecting conduit sections 52 and 56 disposed between adjacent pairs of the chambers 50. Conduit sections 56 are generally longer than the conduit sections 52. The purpose of the differing lengths of the conduit sections 52 and 56 will be described in more detail below.

Figure 4:
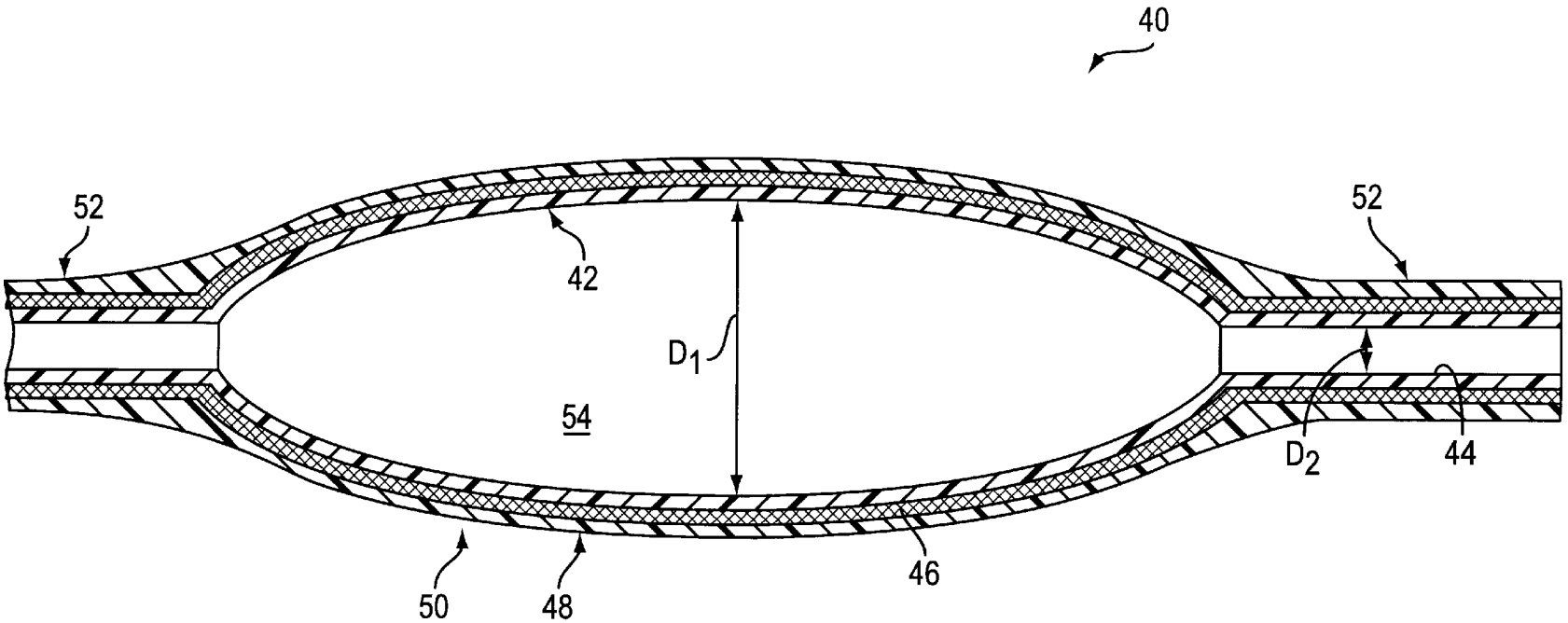
FIG. 4 is a partial longitudinal sectional view along line 4—4 in FIG. 3.

FIG. 4 shows an enlarged longitudinal section of a single hollow chamber 50 and portions of adjacent conduit sections 52 of the pressure vessel 40. The pressure vessel 40 preferably has a layered construction including polymeric hollow shells 42 with polymeric connecting conduits 44 extended from opposed open ends of the shells 42. The polymeric shells 42 and the polymeric connecting conduits 44 are preferably formed from a synthetic plastic material such as Teflon or fluorinated ethylene propylene and may be formed by any of a number of known plastic-forming techniques such as extrusion, roto molding, chain blow molding, or injection molding.

Materials used for forming the shells 42 and connecting conduits 44 are preferably moldable and exhibit high tensile strength and tear resistance. Most preferably, the polymeric hollow shells 42 and the polymeric connecting conduits 44 are formed from a thermoplastic polyurethane elastomer manufactured by Dow Plastics under the name Pellethane® 2363-90AE, a thermoplastic polyurethane elastomer manufactured by the Bayer Corporation, Plastics Division under the name Texin® 5286, a flexible polyester manufactured by Dupont under the name Hytrel®, or polyvinyl chloride from Teknor Apex.

In a preferred configuration, the volume of the hollow interior 54 of each chamber 50 is within a range of capacities configurable for different applications, with a most preferred volume of about thirty (30) milliliters. It is not necessary that each chamber have the same dimensions or have the same capacity. It has been determined that a pressure vessel 40 having a construction as will be described below will undergo a volume expansion of 7–10% when subjected to an internal pressure of 2000 psi. In a preferred configuration, the polymeric shells 42 each have a longitudinal length of about 3.0–3.5 inches, with a most preferred length of 3.250–3.330 inches, and a maximum outside diameter of about 0.800 to 1.200 inches, with a most preferred diameter of 0.095–1.050 inches. The conduits 44 have an inside diameter $D_2$ preferably ranging from 0.125–0.300 inches with a most preferred range of about 0.175–0.250 inches. The hollow shells 42 have a typical wall thickness ranging from 0.03 to 0.05 inches with a most preferred typical thickness of about 0.04 inches. The connecting conduits 44 have a wall thickness ranging from 0.03 to 0.10 inches and preferably have a typical wall thickness of about 0.040 inches, but, due to the differing amounts of expansion experienced in the hollow shells 42 and the conduits 44 during a blow molding forming process, the conduits 44 may actually have a typical wall thickness of about 0.088 inches.

The exterior surface of the polymeric hollow shells 42 and the polymeric connecting conduits 44 is preferably wrapped with a suitable reinforcing filament fiber 46. Filament layer 46 may be either a winding or a braid (preferably a triaxial braid pattern having a nominal braid angle of 75 degrees) and is preferably a high-strength aramid fiber material such as Kevlar® (preferably 1420 denier fibers), carbon fibers, or nylon, with Kevlar® being most preferred. Other potentially suitable filament fiber material may include thin metal wire, glass, polyester, or graphite. The Kevlar winding layer has a preferred thickness of about 0.035 to 0.055 inches, with a thickness of about 0.045 inches being most preferred.

A protective coating 48 may be applied over the layer of filament fiber 46. The protective coating 48 protects the shells 42, conduits 44, and the filament fiber 46 from abrasions, UV rays, thermal elements, or moisture. Protective coating 32 is preferably a sprayed-on synthetic plastic coating. Suitable materials include polyvinyl chloride and polyurethane. The protective coating 32 may be applied to the entire pressure vessel 40, or only to more vulnerable portions thereof. Alternatively, the protective coating 32 could be dispensed with altogether if the pressure vessel 40 is encased in a protective, moisture-impervious housing.

The inside diameter $D_1$ of the hollow shell 42 is preferably much greater than the inside diameter $D_2$ of the conduit section 44, thereby defining a relatively discreet storage chamber within the hollow interior 54 of each polymeric shell 42. This serves as a mechanism for reducing the kinetic energy released upon the rupturing of one of the chambers 50 of the pressure vessel 40. That is, if one of the chambers 50 should rupture, the volume of pressurized fluid within that particular chamber would escape immediately. Pressurized fluid in the remaining chambers would also move toward the rupture, but the kinetic energy of the escape of the fluid in the remaining chambers would be regulated by the relatively narrow conduit sections 44 through which the fluid must flow on its way to the ruptured chamber. Accordingly, immediate release of the entire content of the pressure vessel is avoided.

Figure 5:
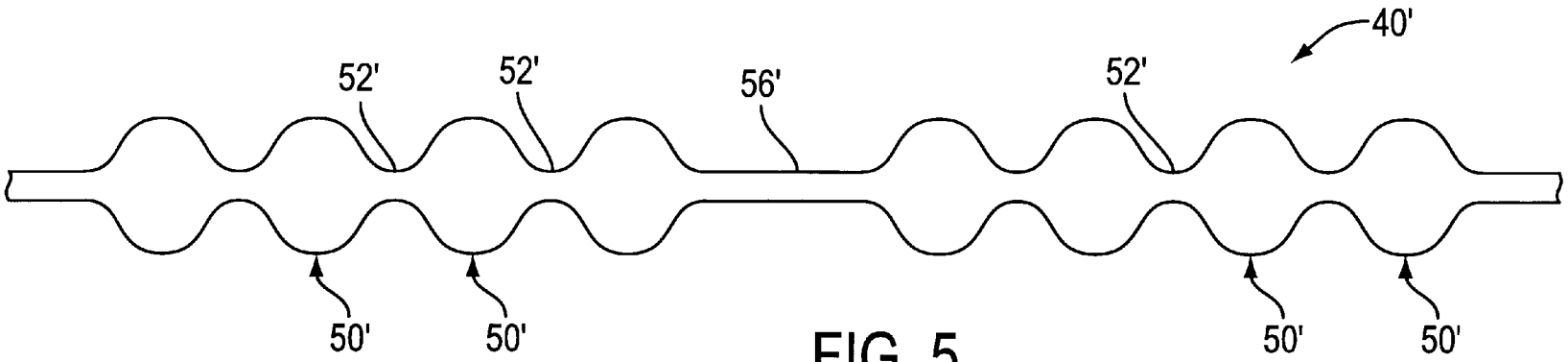
FIG. 5 is a side elevational view of an alternative embodiment of the container system of the present invention.
Figure 5A:
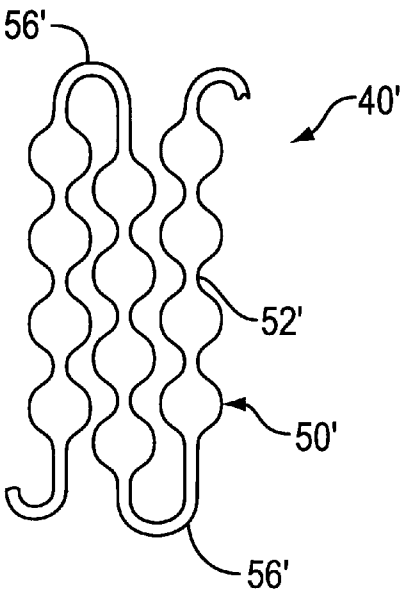
FIG. 5A is a partial view of the container system of FIG. 5 arranged in a sinuous configuration.

An alternate pressure vessel 40' is shown in FIGS. 5 and 5A. Pressure vessel 40' includes a plurality of hollow chambers 50' having a generally spherical shape connected by conduit sections 52' and 56'. As shown in FIG. 5A, one particular configuration of the pressure vessel 40' is to bend it back-and-forth upon itself in a sinuous fashion. The pressure vessel 40' is bent at the elongated conduit sections 56', which are elongated relative to the conduit sections 52' so that they can be bent without kinking or without adjacent hollow chambers 50' interfering with each other. Accordingly, the length of the conduit sections 56' can be defined so as to permit the pressure vessel to be bent thereat without kinking and without adjacent hollow chambers 50' interfering with each other. In general, a connecting conduit section 56' of sufficient length can be provided by omitting a chamber 50' in the interconnected series of chambers 50'. The length of a long conduit section 56', however, need not necessarily be as long as the length of a single chamber 50'.

Both ellipsoidal and the spherical chambers are preferred, because such shapes are better suited than other shapes, such as cylinders, to withstand high internal pressures. Spherical chambers 50' are not, however, as preferable as the generally ellipsoidal chambers 50 of FIGS. 3 and 4, because, the more rounded a surface is, the more difficult it is to apply a consistent winding of reinforcing filament fiber. Filament fibers, being applied with axial tension, are more prone to slipping on highly rounded, convex surfaces.

A portable pressure pack 60 employing a pressure vessel 40 as described above is shown in FIG. 6. Note that the pressure pack 60 includes a pressure vessel 40 having generally ellipsoidal hollow chambers 50. It should be understood, however, that a pressure vessel 40 of a type having generally spherical hollow chambers as shown in FIGS. 5 and 5A could be employed in the pressure pack 60 as well. The pressure vessel 40 is arranged as a continuous, serial strand 58 of interconnected chambers 50 bent back-and-forth upon itself in a sinuous fashion with all of the chambers lying generally in a common plane. In general, the axial arrangement of any strand of interconnected chambers can be an orientation in any angle in X-Y-Z cartesian space. Note again, in FIG. 6, that elongated conduit sections 56 are provided. Sections 56 are substantially longer than conduit sections 52 and are provided to permit the pressure vessel 40 to be bent back upon itself without kinking the conduit section 56 or without adjacent chambers 50 interfering with one another. Again, an interconnecting conduit 56 of sufficient length for bending can be provided by omitting a chamber 50 from the strand 58 of interconnected chambers.

The pressure vessel 40 is encased in a protective housing 62. Housing 62 may have a handle, such as an opening 64, provided therein.

A fluid transfer control system 76 is pneumatically connected to the pressure vessel 40 and is operable to control transfer of fluid under pressure into or out of the pressure vessel 40. In the embodiment illustrated in FIG. 6, the fluid transfer control system includes a one-way inlet valve 70 (also known as a fill valve) pneumatically connected (e.g., by a crimp or swage) to a first end 72 of the strand 58 and a one-way outlet valve/regulator 66 pneumatically connected (e.g., by a crimp or swage) to a second end 74 of the pressure vessel 40. The inlet valve 70 includes a mechanism permitting fluid to be transferred from a pressurized fluid fill source into the pressure vessel 40 through inlet valve 70 and to prevent fluid within the pressure vessel 40 from escaping through the inlet valve 70. The outlet valve/regulator 66 includes a well known mechanism permitting the outlet valve/regulator to be selectively configured to either prevent fluid within the pressure vessel 40 from escaping the vessel through the valve 66 or to permit fluid within the pressure vessel 40 to escape the vessel in a controlled manner through the valve 66. Preferably, the outlet valve/regulator 66 is operable to "step down" the pressure of fluid exiting the pressure vessel 40. For example, in typical medicinal applications of ambulatory oxygen, oxygen may be stored within the tank at up to 3,000 psi, and a regulator is provided to step down the outlet pressure to 20 to 50 psi. The outlet valve/regulator 66 may include a manually-operable control knob 68 for permitting manual control of a flow rate therefrom.

A pressure relief valve (not shown) is preferably provided to accommodate internal pressure fluctuations due to thermal cycling or other causes.

Figure 6:
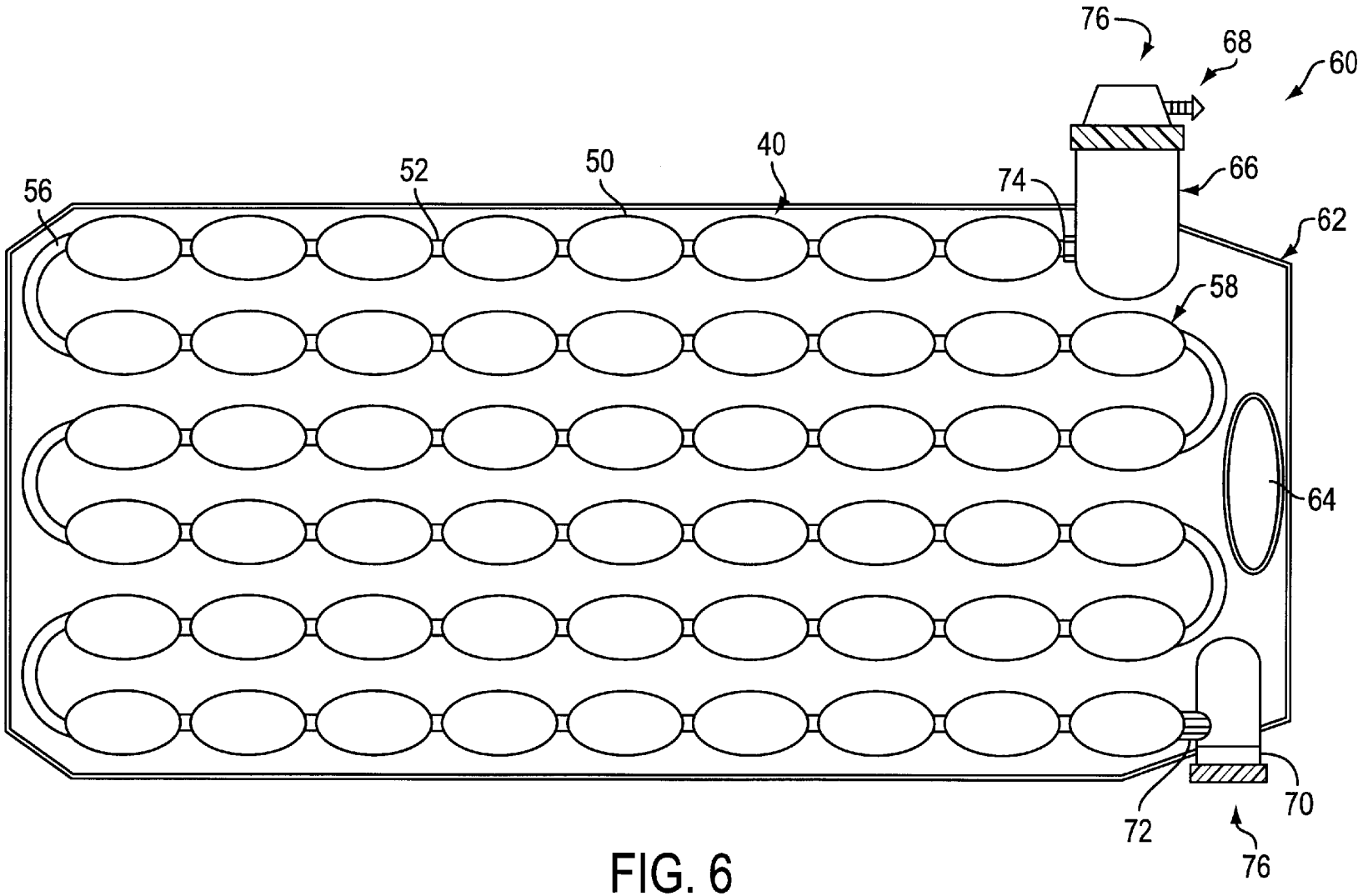
FIG. 6 is a portable pressurized fluid pack employing a container system according to the present invention.

In FIG. 6, the pressure vessel 40, inlet valve 70, and the outlet valve/regulator 66 are shown exposed on top of the housing 62. Preferably, the housing comprises dual halves of, for example, preformed foam shells that encase the pressure vessel 40. For the purposes of illustrating the structure of the embodiment of FIG. 6, however, a top half of the housing 62 is not shown. It should be understood, however, that a housing would substantially encase the pressure vessel 40 and at least portions of the outlet valve/regulator 66 and the inlet valve 70.

Figure 7:
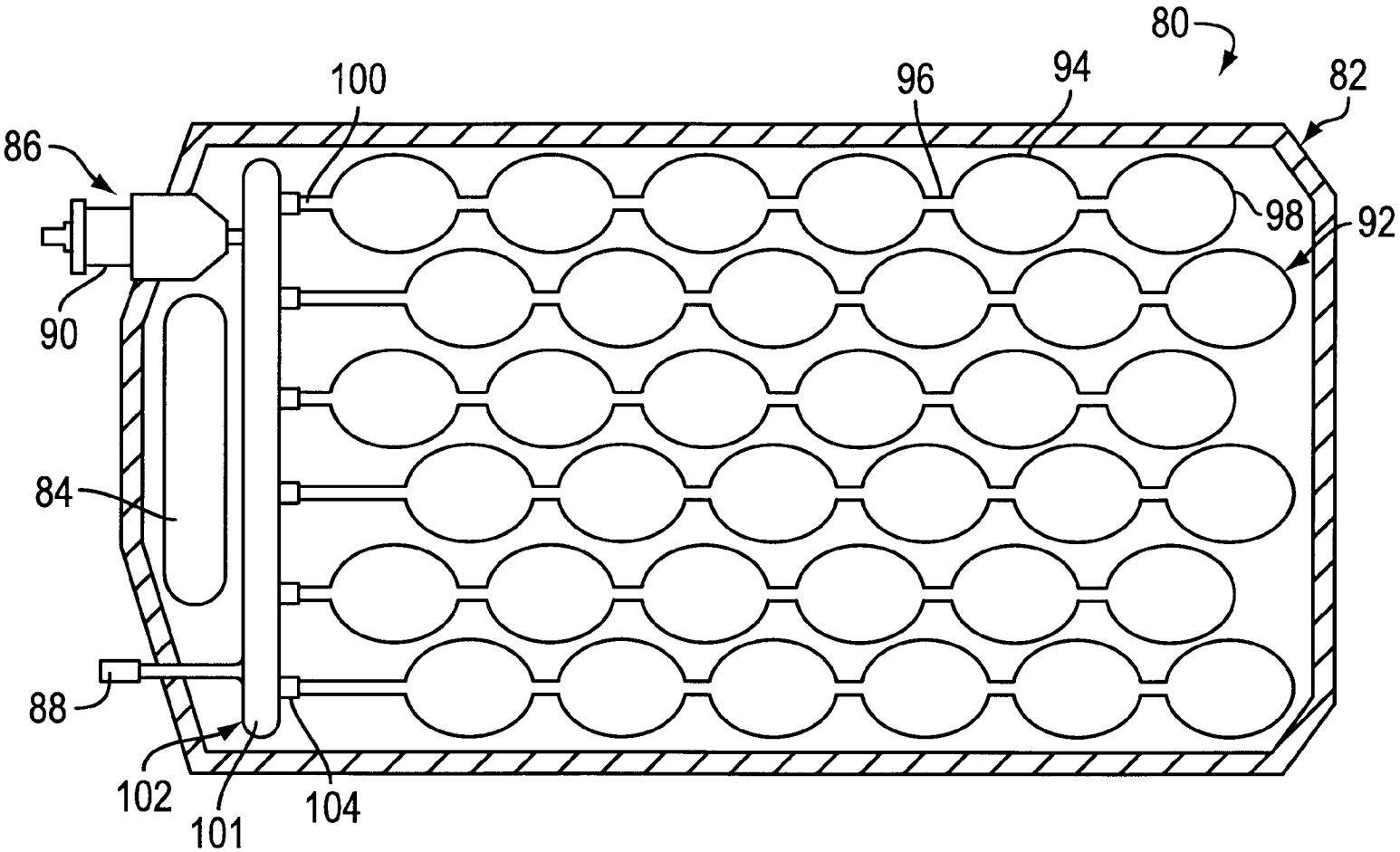
FIG. 7 is an alternate embodiment of a pressurized fluid pack employing the container system of the present invention.

FIG. 7 shows an alternate embodiment of a portable pressure pack generally designated by reference number 80. The pressure pack 80 includes a pressure vessel formed by a number of strands 92 of individual chambers 94 serially interconnected by interconnecting conduit sections 96 and arrange generally in parallel to each other. In the embodiment illustrated in FIG. 7, the pressure vessel includes six individual strands 92, but the pressure pack may include fewer than or more than six strands.

Each of the strands 92 has a first closed end 98 at the endmost of the chambers 94 of the strand 92 and an open terminal end 100 attached to a coupling structure defining an inner plenum, which, in the illustrated embodiment, comprises a distributor 102. The distributor 102 includes an elongated, generally hollow body 101 defining the inner plenum therein. Each of the strands 92 of interconnected chambers is pneumatically connected at its respective terminal end 100 by a connecting nipple 104 extending from the elongated body 101, so that each strand 92 of interconnected chambers 94 is in pneumatic communication with the inner plenum inside the distributor 102. Each strand 92 may be connected to the distributor 102 by a threaded interconnection, a crimp, or a swage, or any other suitable means for connecting a high pressure polymeric tube to a rigid fitting. A fluid transfer control system 86 is pneumatically connected to the distributor 102. In the illustrated embodiment, the fluid transfer control system 86 includes a one-way inlet valve 86 and a one-way outlet/regulator 90 pneumatically connected at generally opposite ends of the body 101 of the distributor 102.

The strands 92 of interconnected chambers 94, the distributor 102, and at least portions of the inlet valve 88 and the outlet valve/regulator 90 are encased within a housing 82, which may include a handle 84, as illustrated in FIG. 7, to facilitate carrying of the pressure pack 80.

Figure 8:
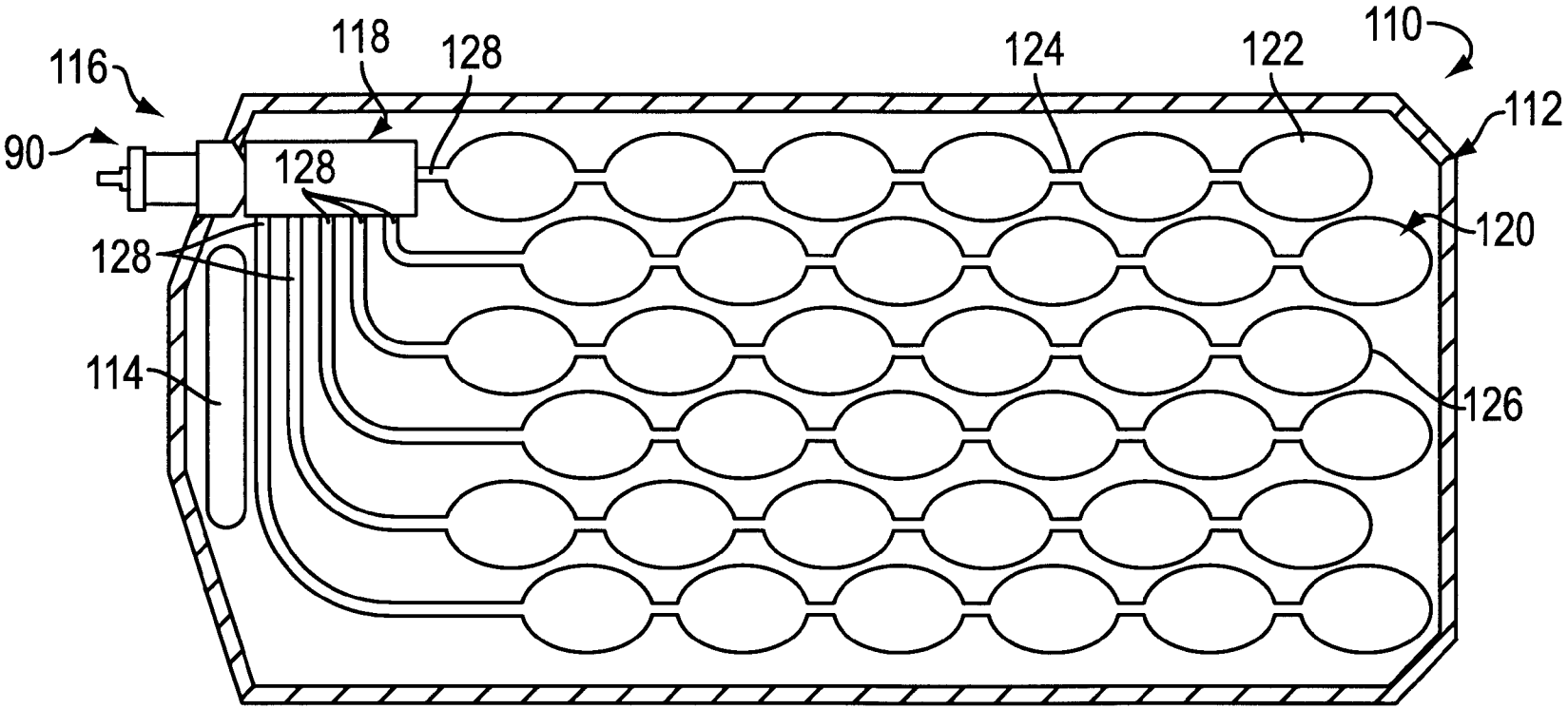
FIG. 8 is still another alternate embodiment of a pressurized fluid pack employing a container system according to the present invention.

In FIG. 8 is shown still another alternative embodiment of a pressure pack generally designated by reference number 110. The pressure pack 110 includes a pressure vessel comprised of a number of generally parallel strands 120 of hollow chambers 122 serially interconnected by interconnecting conduit sections 124. Each of the strands 120 has a closed end 126 at the endmost of its chambers 122 and an open terminal end 128 attached to a coupling structure defining an inner plenum. In the illustrated embodiment, the coupling structure comprises a manifold 118 to which is pneumatically attached each of the respective terminal ends 128 of the strands 120. Each strand 120 may be connected to the manifold 118 by a threaded interconnection, a crimp, or a swage, or any other suitable means for connecting a high pressure polymeric tube to a rigid fitting. A fluid transfer control system 116 is attached to the manifold 118, and, in the illustrated embodiment, comprises a outlet valve/regulator 90 and an inlet valve (not shown).

The hollow chambers of the pressure vessels described above and shown in FIGS. 5A, 6, 7, and 8 can be of the type shown in FIGS. 2 and 2A having an internal perforated tubular core, or they can be of the type shown in FIG. 4 having no internal tubular core.

Figure 9:
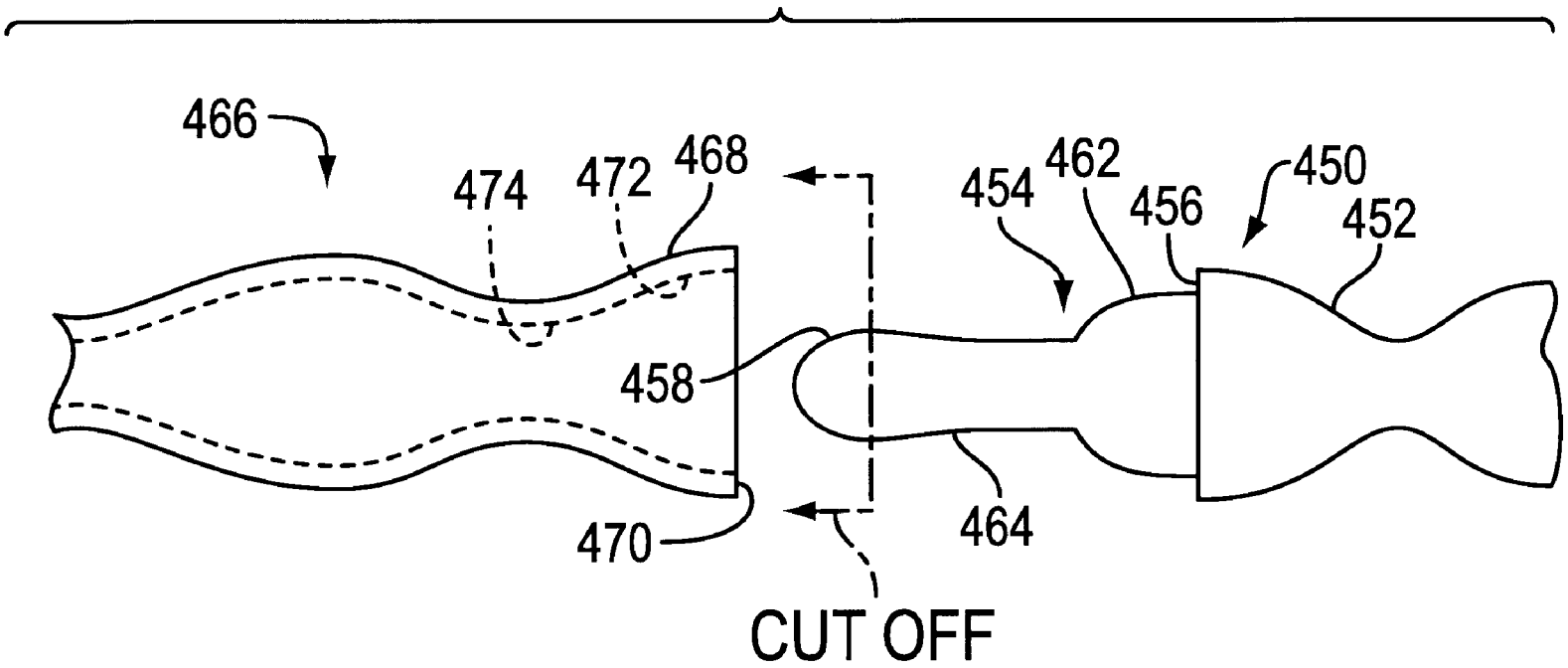
FIG. 9 is a partial side elevational view showing a method and arrangement for adhesively connecting together portions of a container system of the present invention.
Figure 10:
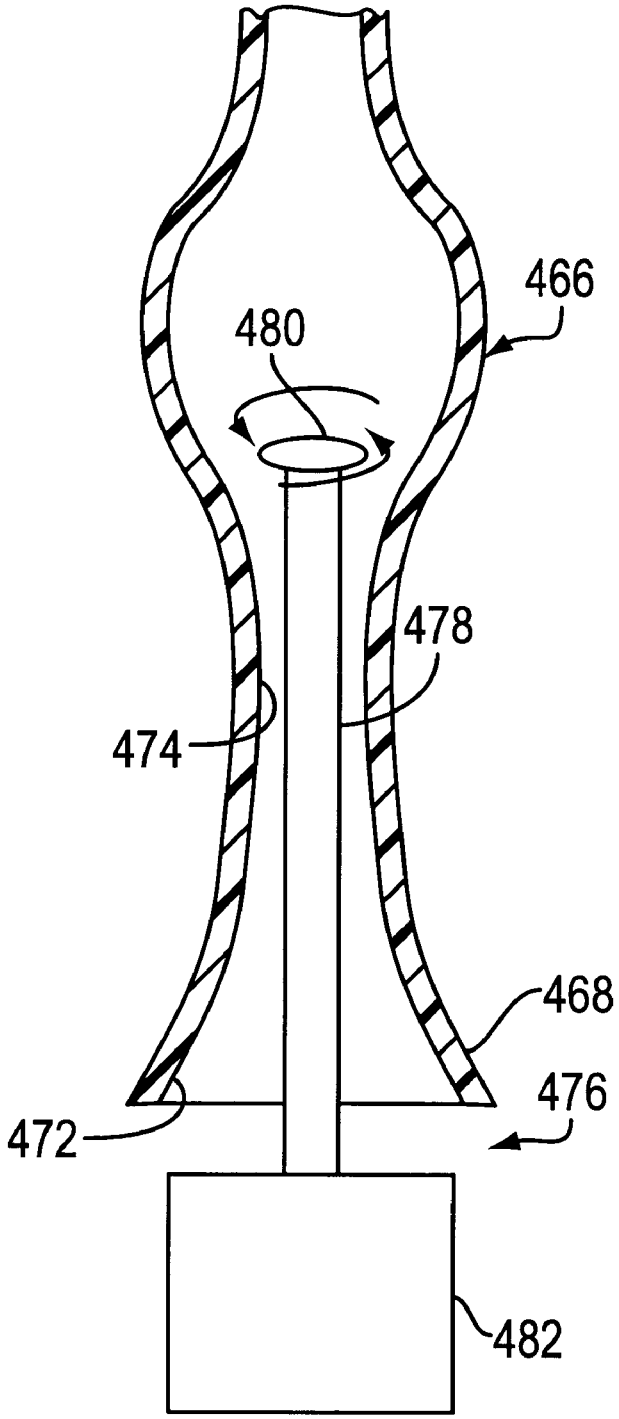
FIG. 10 is a partial side sectional view showing an alternative arrangement for adhesively connecting together portions of a container system of the present invention along with an adhesive applicator.

Forming a continuous, seamless strand of interconnected chambers of sufficient length to construct the pressure vessel 40 shown in FIG. 6, or for longer strands employed in the pressure vessels of FIGS. 7 and 8, is difficult to do with conventional polymer forming techniques. To form a continuous strand of sufficient length, two or more shorter strands can be serially connected together to form the longer strand. A preferred method and arrangement for serially connecting lengths of interconnected chambers together is shown in FIGS. 9 and 10.

A first strand 450 is connected to a second strand 466 to form a continuous strand longer than either of strands 450 and 466. Strand 450 is preferably blow molded to have a series of hollow spherical or ellipsoidal chambers interconnected by conduit sections. The end chamber 452 is formed as a male connector 454 having a curved, convex outer surface portion 462 and a straight, cylindrical outer surface portion 464. The curved, convex surface portion 462 of the connector 454 preferably has a length corresponding to about half the length, or less, of a single chamber. The convex outer surface portion 462 and cylindrical outer surface portion 464 have shapes generally conforming to an inner surface of a chamber, as will be described below. The maximum outer width of the convex portion 462 is less than that of the remainder of the end chamber 452, so that an annular shoulder 456 is defined at the base of the male connector 454.

The first strand 450, with the male connector 454, can be formed by a blow molding technique with an appropriately-shaped mold.

A truncated chamber 468 defines a female connector at the end of the second strand 466. An annular edge 470 is defined at the end of the truncated chamber 468, and the female connector includes a curved, concave inner surface portion 472 and a straight, cylindrical inner surface portion 474.

The convex outer surface portion 462 and the cylindrical outer surface portion 464 are sized and shaped to conform to the concave inner surface portion 472 and the cylindrical inner surface portion 474, respectively, with the annular edge 470 engaged with the annular shoulder 456. The length of the truncated chamber 468 is preferably such that it, together with the remaining portion of the end chamber 452 of the first strand 450, has a length that is approximately the same as each of the other chambers in the two strands 450, 466. More specifically, the length of the truncated chamber 468 is preferably the same as that of the curved, convex portion 462 of the male connector 454 of the first strand 450. The truncated chamber 468, and, therefore, the curved, convex portion 462, should be no more than one-half the length of a complete chamber. This is because, in order to be able to insert the male connector 454 into the truncated chamber 468, the truncated chamber 468 should be outwardly expanding along its entire length.

The first strand 450 is secured to the second strand 466 by dipping the male connector 454 of the first strand into an appropriate adhesive, cutting off a closed-end tip 458, and thereafter inserting the male connector 454 into contact with the female connector surfaces 472 and 474 until the annular edge 470 engages the annular shoulder 456. Suitable adhesives include light cure acrylic adhesives sold under product numbers 3311 and 3341 by Locate Corporation.

An alternative adhesive application technique is shown in FIG. 10. In the technique shown in FIG. 10, rather than applying adhesive to the exterior of the male connector 454 of the first strand 450, an adhesive applicator 476 is used to apply adhesive to the inner surfaces 472 and 474 of the female connector of the second strand 466. The applicator 476 includes an elongated applicator shaft 478 with an applicator element 480 (e.g., a brush) at the end thereof. The base of the shaft 478 extends into a housing 482 that may contain a motor (not shown) for rotating the shaft 478 and/or a supply of adhesive and a mechanism for forcing adhesive to the applicator element 480 at the end of the shaft 478. Alteratively, the shaft 478 may be manually rotatable, such as by manually rotating the housing 482 to which the shaft 478 is attached.

Applicators of the type shown are available from Loctite Corporation.

Using the applicator 476, a layer of adhesive can be applied to the inner surfaces 472 and 474, and, after cutting the tip 458 off the male connector 454, the male connector can be inserted into the female connector to connect the strands 450 and 466 together.

While the invention has been described in connection with what are presently considered to be the most practical and preferred embodiments, it is to be understood that the invention is not to be limited to the disclosed embodiments, but, on the contrary, it is intended to cover various modifications and equivalent arrangements included within the spirit and scope of the appended claims. Thus, it is to be understood that variations in the particular parameters used in defining the present invention can be made without departing from the novel aspects of this invention as defined in the following claims.

What is claimed is:

1. An assembly comprising:

a first strand of hollow polymeric chambers interconnected by conduit sections, said hollow chambers having a larger interior width than said conduit sections, an end one of the polymeric chambers of said first strand being formed so as to have a connecting portion defining an outer surface contoured so as to generally conform to a portion of an inner surface of a one of said hollow chambers; and a second strand of hollow polymeric chambers interconnected by conduit sections, said hollow chambers having a larger interior width than said conduit sections, an end one of the polymeric chambers of said second strand being formed as a partial chamber defining an inner surface generally conforming to said outer surface of said connecting portion;

said first strand being connected to said second strand by inserting said connecting portion of said first strand into said partial end chamber of said second strand with said outer surface of said connecting portion engaging said inner surface of said partial end chamber.

2. The assembly of claim 1, said outer surface of said connecting portion of said first strand including a curved, convex outer surface and a generally cylindrical outer surface extending from an end of the curved, convex outer surface, a maximum transverse outer dimension of said curved convex outer surface being less than that of a remainder of said end chamber, thereby defining a shoulder at a transition between said curved convex surface and the remainder of the end chamber, and said inner surface of said partial end chamber of said second strand defining an inner, concave surface generally conforming to said curved, convex outer surface and an end surface generally conforming to said shoulder.

3. The assembly of claim 1, wherein said first and second strands are formed from a thermoplastic polyurethane elastomer.

4. The assembly of claim 1, further comprising an adhesive bond between at least a portions of said outer surface of said connecting portion of said first strand and said inner surface of said partial chamber of said second strand.

5. The assembly of claim 4, wherein said adhesive bond comprises a light-curable adhesive.

6. The assembly of claim 1, further comprising a reinforcing filament wrapped around said connected first and second strands.

7. The assembly of claim 1, further comprising a fluid transfer control system attached to said connected first and second strands and constructed and arranged to control flow of fluid into and out of said connected first and second strands.

8. The assembly of claim 1, said hollow chambers of said first and second strands having an ellipsoidal shape.

9. The assembly of claim 1, said hollow chambers of said first and second strands having a spherical shape.

10. A method comprising:

providing a first strand of hollow polymeric chambers interconnected by conduit sections, said hollow chambers having a larger interior width than said conduit sections, an end one of the polymeric chambers of said first strand being formed so as to have a connecting portion defining an outer surface contoured so as to generally conform to a portion of an inner surface of a one of said hollow chambers;

providing a second strand of hollow polymeric chambers interconnected by conduit sections, said hollow chambers having a larger interior width than said conduit sections, an end one of the polymeric chambers of said second strand being formed as a partial chamber defining an inner surface generally conforming to said outer surface of said connecting portion;

applying an adhesive to at least a portion of one of said outer surface of said connection portion and said inner surface of said partial end chamber; and inserting said connecting portion of said first strand into said partial end chamber of said second strand.

11. The method of claim 10, further comprising applying adhesive onto said inner surface of said partial chamber with an adhesive applicator including an elongated applicator shaft with an applicator element at the end thereof.

12. The method of claim 10, further comprising applying a reinforcing filament over the connected first and second strands.

* * * * *